US005327833A

United States Patent [19]

Danielson

[11] Patent Number: 5,327,833

[45] Date of Patent: * Jul. 12, 1994

[54] MULTIPLE INK ZERO CALIBRATION FOR PRINTING PRESS

[75] Inventor: Michael T. Danielson, Roselle, Ill.

[73] Assignee: Rockwell International Corporation, El Segundo, Calif.

[ * ] Notice: The portion of the term of this patent subsequent to Feb. 13, 2007 has been disclaimed.

[21] Appl. No.: 960,179

[22] Filed: Oct. 9, 1992

Related U.S. Application Data

[63] Continuation of Ser. No. 732,438, Jul. 18, 1991, abandoned, which is a continuation-in-part of Ser. No. 414,790, Sep. 29, 1989, abandoned.

[51] Int. Cl.[5] ..... B41F 7/30; B41L 25/06; B41L 25/02

[52] U.S. Cl. ..... 101/484; 101/366

[58] Field of Search ..... 101/365, 366, 350, 148, 101/363, DIG. 45, DIG. 47, 483, 484, 485; 118/696, 697, 699, 706, 259, 300, 313; 239/550; 137/624.11, 624.12, 624.18

[56] References Cited

U.S. PATENT DOCUMENTS 4,899,653 2/1990 Michl et al. ..... 101/148

FOREIGN PATENT DOCUMENTS 2024457 1/1980 United Kingdom ..... 101/DIG. 47

*Primary Examiner*—J. Reed Fisher

*Attorney, Agent, or Firm*—C. B. Patti; H. F. Hamann

[57] ABSTRACT

A method of providing a software zero state for a plurality of ink adjusting modules in a printing press. Each of the ink adjusting modules are provided for adjusting an associated plunger assembly for dispensing ink to an ink rail in the printing press, each ink adjusting module having an ink control lever which contacts the plunger assembly to change the ink volume being pumped by the associated plunger assembly to the ink rail, having a mechanical stop for the ink control lever and having an adjustable ink control rod contacting the ink control lever. The method has the steps of: placing the printing press in a manual mode; positioning the ink control lever of each ink adjustment module at the associated mechanical stop; operating a bidirectional motor in each ink adjustment module to move the ink control lever to a position corresponding to a desired black printing via the ink module control rod which is connected to the motor and which contacts the control lever; and measuring the position of the motor with a potentiometer; storing the position of each motor, from a position value output by the associated potentiometer, in a memory thereby providing the software zeros for the printing press.

6 Claims, 10 Drawing Sheets

MULTIPLE INK ZERO CALIBRATION FOR PRINTING PRESS

This application is a continuation of application Ser. No. 07/732,438, filed Jul. 18, 1991, now abandoned which is a continuation-in-part of application Ser. No. 07/414,790, filed Sep. 29, 1989, now abandoned.

BACKGROUND OF THE INVENTION

The present invention relates to offset printing presses and, particularly, to the electronic control of such presses.

Web offset printing presses have gained widespread acceptance by metropolitan daily as well as weekly newspapers. Such presses produce a quality black and white or color product at very high speeds. To maintain image quality, a number of printing functions must be controlled very precisely as the press is operating. These include the control of press speed, the control of color register, the control of ink flow and the control of dampening water.

In all printing processes there must be some way to separate the image area from the non-image area. This is done in letterpress printing by raising the image area above the non-image area and is termed "relief printing". The ink roller only touches the high part of the plate, which in turn, touches the paper to transfer the ink. In offset lithography, however, the separation is achieved chemically. The lithographic plate has a flat surface and the image area is made grease-receptive so that it will accept ink, and the non-image area is made water-receptive so it will repel ink when wet.

In a web offset printing press the lithographic plate is mounted to a rotating plate cylinder. The ink is injected onto an ink pickup roller and from there it is conveyed through a series of transfer rollers which spread the ink uniformly along their length and transfer the ink to the image areas of the rotating plate. Similarly, dampening water is applied to a fountain roller and is conveyed through one or more transfer rollers to the non-image areas of the rotating plate cylinder. The plate cylinder rotates in contact with a blanket cylinder which transfers the ink image from the plate cylinder to the moving paper web.

It is readily apparent that the amount of ink and dampening water supplied to the plate cylinder is directly proportional to the press speed. At higher press speeds the plate cylinder and blanket cylinder transfer ink and water to the paper web at a higher rate, and the inking and dampening systems must, therefore, supply more ink and water. It is also well known that this relationship is not linear and that the rate at which ink and dampening water is applied follows a complex rate curve which is unique to each press and may be unique to each run on a press. Not so apparent is the fact that the ink and water may be applied non-uniformly across the width of the ink pickup roller and the fountain roller in order to achieve uniform printing quality along the width of the web. If this is not done, there may be significant changes in the quality of the printed images across the width of the moving web.

Prior press control systems have provided limited control over the rate at which dampening water and ink has been applied as a function of press speed. For example, in the case of damping water, these systems pulse the nozzles on the spray bar on and off at one of a plurality of selectable pulse rates. The particular pulse rate selected is determined by the press speed. The particular pulse rates and selection points between pulse rates is preset to follow the dampening rate curve of the press as closely as possible. There is no means for easily changing these values or for providing a continuous range of pulse rates which closely follow the rate curve. In addition, while the amount of dampening water applied by the spray bar can be adjusted over the width thereof, this is a manual adjustment which may only be made locally at a spray bar controller. Thus, if inconsistencies in print quality are observed over the width of the image, manual adjustments to the circuitry must be made at a local control panel.

SUMMARY OF THE INVENTION

The present invention relates to a control method for an offset printing press and, particularly, to providing ink zero calibration for the printing press.

The method is for providing a software zero state for a plurality of ink adjusting modules in the printing press, each of the ink adjusting modules being provided for adjusting an associated plunger assembly for dispensing ink to an ink rail in the printing press, each ink adjusting module having an ink control lever which contacts the plunger assembly to change the ink volume being pumped by the associated plunger assembly to the ink rail, having a mechanical stop for the ink control lever and having an adjustable ink control rod contacting the ink control lever. The method has the steps of:

placing the printing press in a manual mode;

positioning the ink control lever of each ink adjustment module at the associated mechanical stop;

operating a bidirectional motor in each ink adjustment module to move the ink control lever to a position corresponding to a desired black printing via the ink module control rod which is connected to the motor and which contacts the control lever;

measuring the position of the motor with a potentiometer;

storing the position of each motor from a position value output by the potentiometer in a memory as a function of at leas the ink type used in the printing press, and storing a plurality of sets of software zeroes for at least different ink types;

placing the printing press in an automatic mode;

retrieving the software zeroes from the memory for at least the ink type being used in the printing press; and positioning each of the motors according to their respective software zero before operating the printing press.

The software zeroes can be stored in buffers in each associated couple of the printing press, the printing press having at least one couple and the memory being the buffers.

Alternatively the method can store the software zeroes in a memory in the printing press or the software zeroes can be stored in a memory of a master work station which is connected to the printing press.

When at least the ink type is changed to a new combination in the printing press, the method further has the step of providing the printing press with a set of software zeroes previously stored in the plurality of sets of software zeroes which correspond to the new combination of at least ink type.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
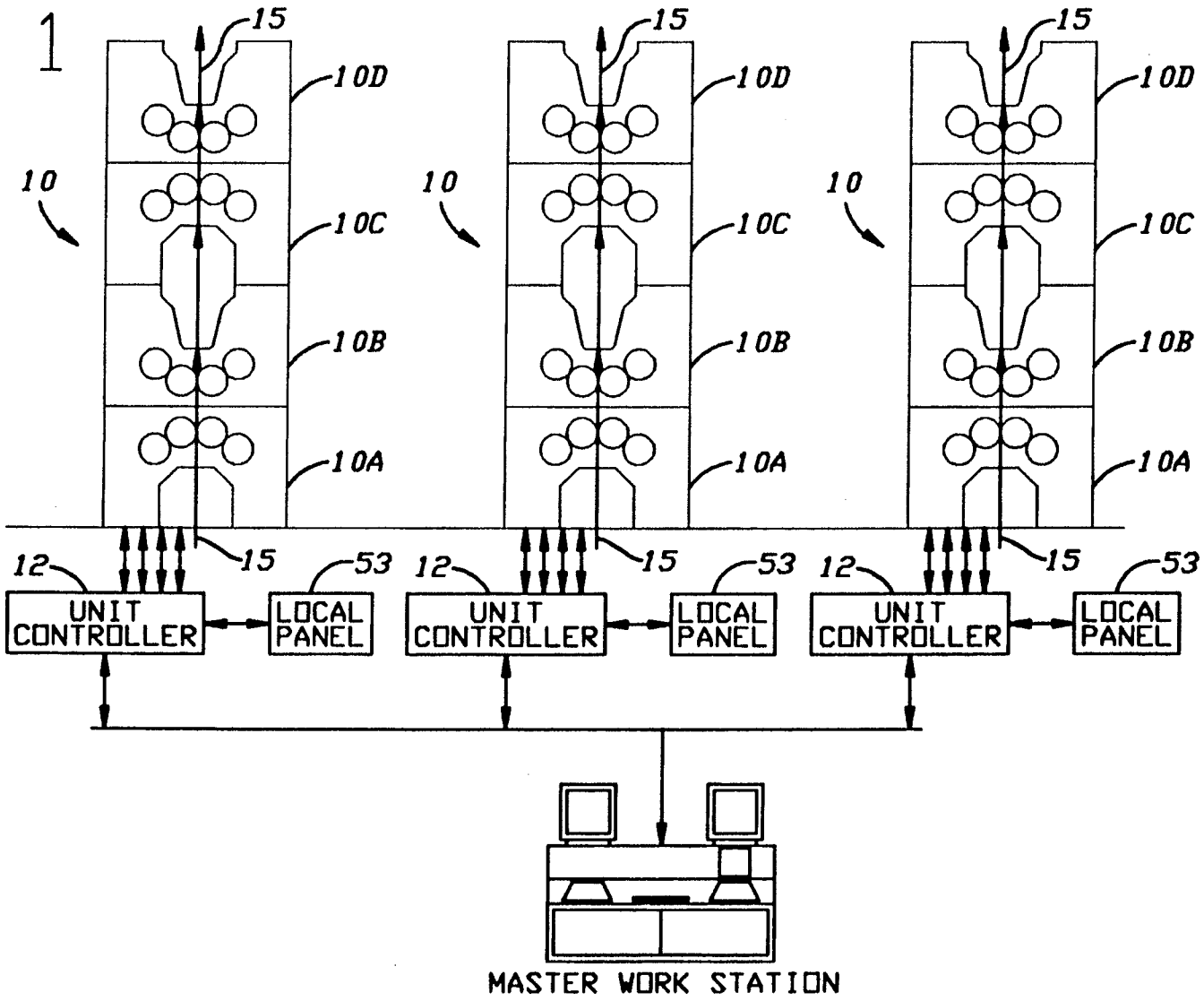
FIG. 1 is a schematic representation of a web offset printing press and its control system.

Referring particularly to FIG. 1, a printing press is comprised of one or more printing units 10 which are controlled from a master work station 11. Each printing unit is linked to the master work station by a unit controller 12 which communicates through a local area network 13. As described in U.S. Pat. No. 4,667,323 (hereby incorporated by reference), the master work station 11 and the unit controllers 12 may send messages to each other through the network 13 to both control the operation of the press and to gather production information.

Figure 2:
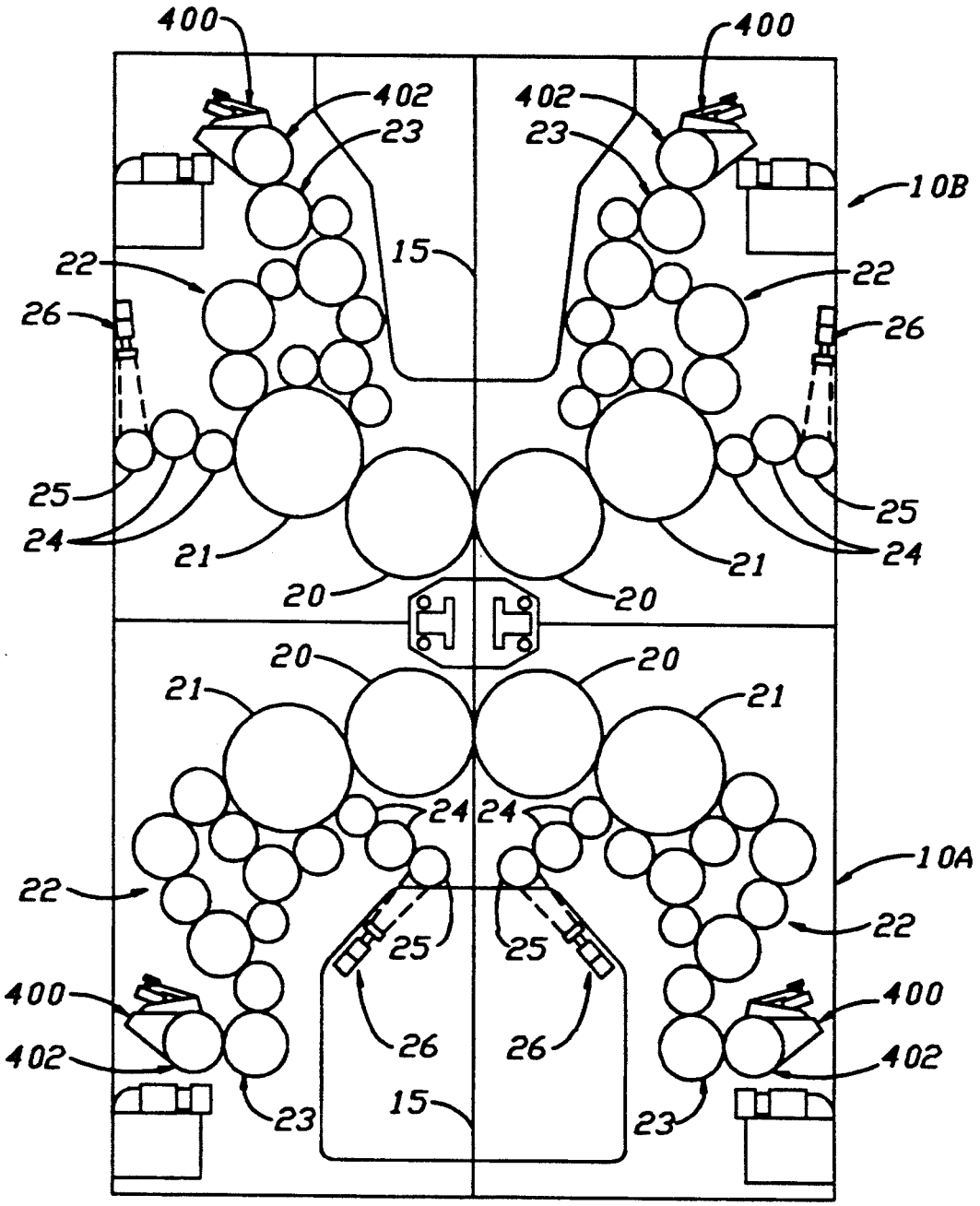
FIG. 2 is a schematic representation of two printing units in the press of FIG. 1.

Referring particularly to FIGS. 1 and 2, each printing unit 10 is comprised of four units which are referred to as levels A, B, C and D and which are designated herein as units 10A, 10B, 10C and 10D. The units 10A-D are stacked one on top of the other and a web 15 passes upward through them for printing on one or both sides. In the preferred embodiment shown, the printing units 10 are configured for full color printing on both sides of the web, where the separate units 10A-D print the respective colors blue, red, yellow and black.

As shown best in FIG. 2, each unit 10A-D includes two printing couples comprised of a blanket cylinder 20 and a plate cylinder 21. The web 15 passes between the blanket cylinders 20 in each unit for printing on both sides. Ink is applied to each plate cylinder 21 by a series of ink transfer rollers 22 which receive ink from an ink pickup roller 23. As is well known in the art, the ink transfer rollers 22 insure that the ink is distributed uniformly along their length and is applied uniformly to the rotating plate cylinder 21. An ink rail 400 applies ink to a distribution ink drum 402 which in turn transfers the ink to the ink pickup roller 23. Similarly, each plate cylinder 21 is supplied with dampening water by a pair of dampener transfer rollers 24 and a dampener rider roller 25. A spray bar assembly 26 applies dampening water to each of the dampener rider rollers 25.

Figure 3:
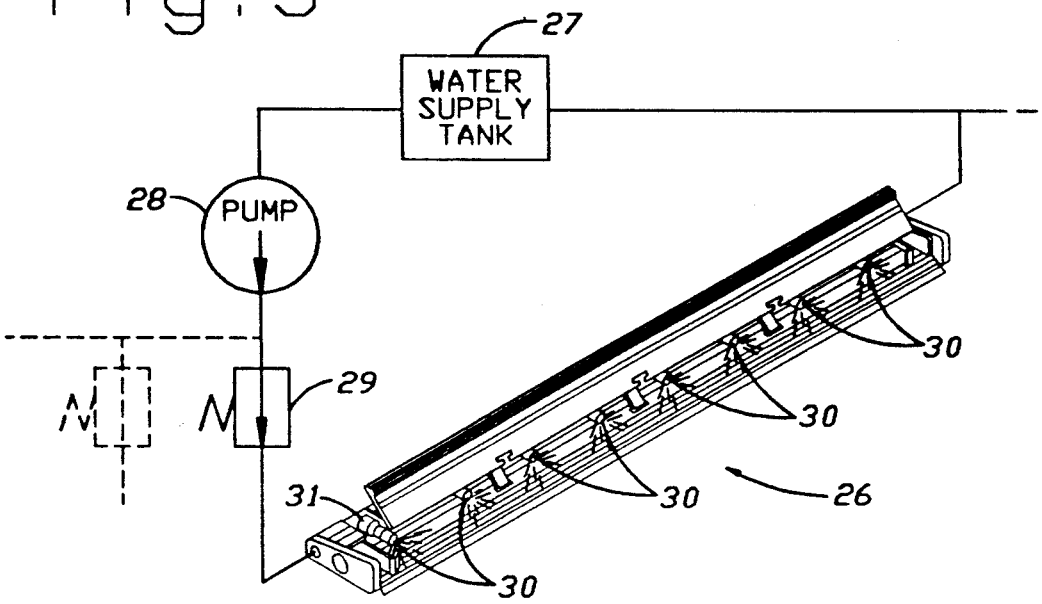
FIG. 3 is a pictorial view of a dampening water spray bar which is employed in the printing units of FIG. 2.

Referring particularly to FIG. 3, each spray bar assembly 26 receives a supply of pressurized water from a water supply tank 27 through a pump 28 and solenoid valve 29. The spray bar assembly 26 includes eight nozzles 30 which each produce a flat, fan-shaped spray pattern of water when an associated solenoid valve 31 is energized. When all eight solenoid valves 31 are energized, a thin line of water is sprayed along the entire length of the associated dampener rider roller 25. As is well known in the art, the solenoid valves 31 are pulsed on and off at a rate which is proportional to press speed so that the proper amount of dampening water is applied and transferred to the plate cylinder 21. It is also well known that means must be provided for separately adjusting the amount of water sprayed by each nozzle 30 to account for variations in the distribution of dampening water over the length of the plate cylinder 21.

Figure 10:
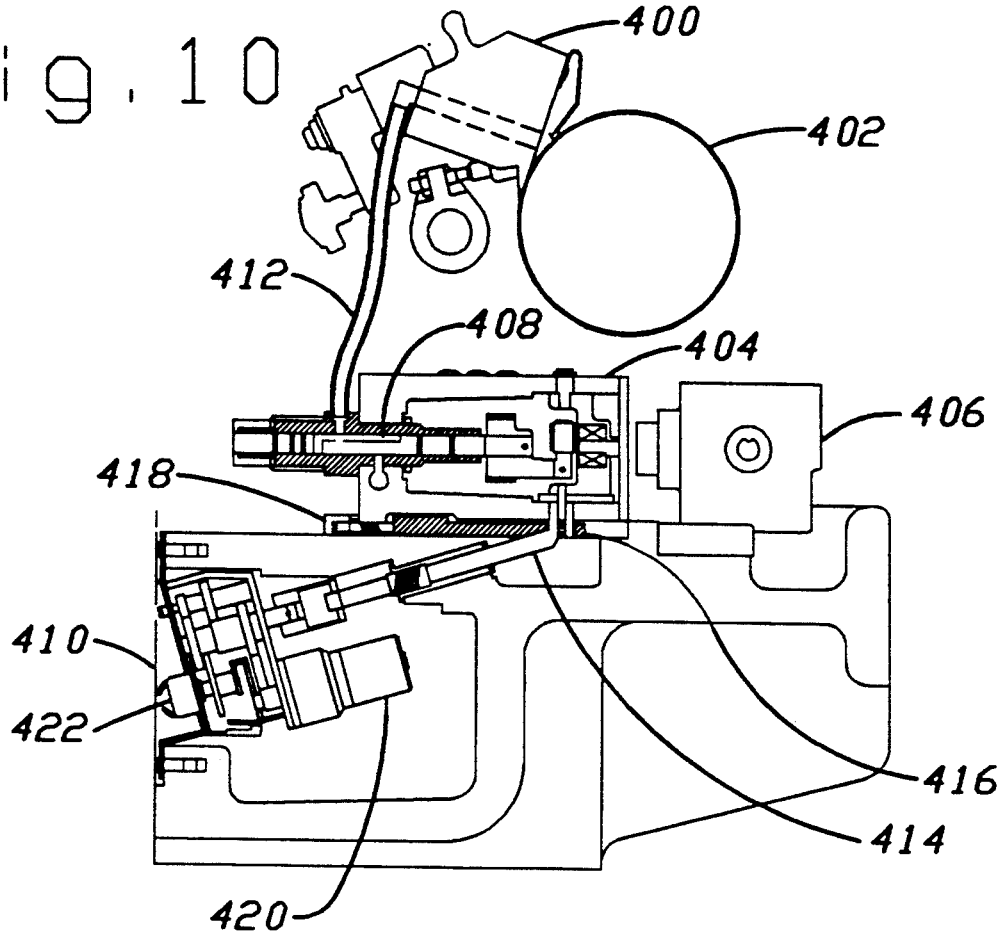
FIG. 10 is a diagram of the ink injector system used in the present invention.
Figure 11:
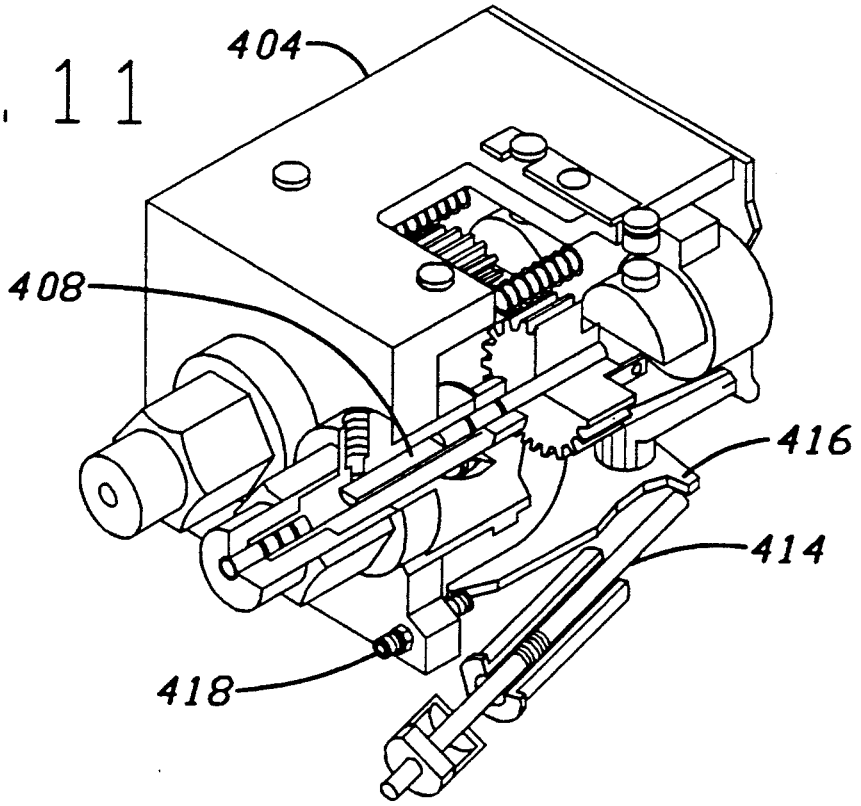
FIG. 11 is a perspective view partially cut away of a portion of the FIG. 10 ink injector system.

The injector ink system delivers a controlled amount of ink to the distribution drum 402. Referring now to FIGS. 10 and 11. Each printing couple has four page packs 404. The page pack 404 is the part of the injector ink system which provides ink to one page position. Page pack gearboxes 406 are located along a drive shaft in the arch of the unit. Each gearbox 406 has a clutch arrangement to engage or silence each page pack 404.

The page pack 404 provides ink to one page which consists of eight columns. Each page pack 404 has eight variable stroke plungers 408 which pump a preset amount of ink to each page column. The stroke of each plunger 408 is set by the ink adjustment modules 410 which are located beneath the page pack 404.

The amount of ink fed to the ink train rollers is determined by:

1. The length of the plunger stroke at each column.
2. The operating speed of the ink motor which operates the page packs 404 and distribution ink drum 402.

During unit operation, the ink motor is controlled by the proportional ink circuit in the operator's console. This circuit will automatically vary ink motor speed with press speed.

Located below each page pack 404 are a series of ink adjustment modules 410. There are 8 ink adjustment modules 410 to a page pack 404 for a total of 32 per printing couple. The ink adjustment module 410 adjusts an ink column by adjusting the stroke of the page pack plunger 408 which increases or decreases the volume of ink fed to the ink rail 410. Ink modules 410 are activated by the controls on a Unit Control Panel, or from the operator's console.

When the ink motor is activated, an ink control rod 414 moves against a spring loaded control lever 416. The control lever 416 and plunger assembly 408 are connected to a common shaft. When the control rod 414 moves, it changes the position of the control lever 416 which changes the length of the pump stroke, thereby changing the ink volume being pumped to the ink rail 400. A mechanical stop 418 contacts the control lever 416 as shown.

A bidirectional motor 420 connected to the ink control rod 414 is provided for establishing a "zero" position of the ink control rod which corresponds to a desired "black" printing quality or other quality of a type or color of ink being used. The position of the bidirectional motor 420 is sensed by potentiometer 422 which outputs a signal which is stored in a memory either in the printing press or a master work station. These stored values are "software zeroes" which are particular to at least a type of ink used in the printing press. When one or all of these elements are changed in the printing press, the previously stored "software zeroes" for this combination is downloaded to reset the ink adjustment modules 410 to the correct zero setting.

The purpose of the ink rail 400 is to supply a predetermined amount of ink to the distribution ink drum 402, The ink rail 400 is located in the aisle side of the unit and extends across the full width of the unit, The rail is hinged so it can be pivoted for cleaning and maintenance, Ink from the four page packs 404 is pumped through connecting hoses 412 to openings in the ink rail body, It then moves through the slots of the orifice plate which is located in the center of the ink rail 400, The rail 400 is contoured and precisely located near the surface of the distribution ink drum 402.

Figure 4:
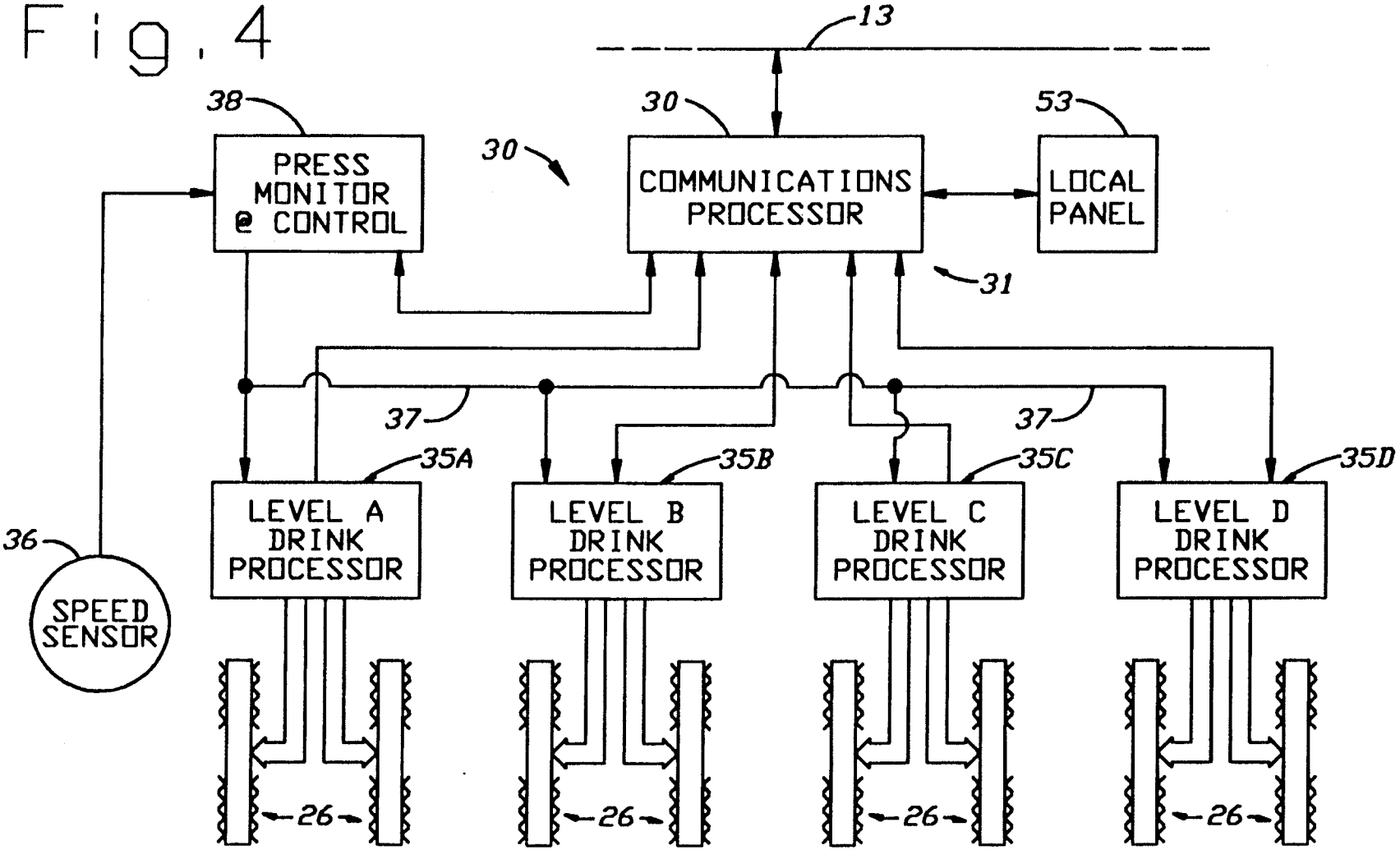
FIG. 4 is an electrical block diagram of a unit controller which forms part of the press control system of FIG. 1.

Referring to FIGS. 2 and 4, the spray bars 26 and ink rails 400 are operated by the unit controllers 12. Each unit controller includes a communications processor 30 of the type disclosed in the above-cited U.S. Pat. No. 4,667,323 which interfaces with the local area network 13. The communications processor 30 provides six serial communications channels 31 through which it can receive input messages for transmission on the network 13. Messages which are received through the network 13 by the communications processor 30 are distributed to the appropriate serial channel 31. The serial communications channels 31 employ a standard RS 422 protocol.

Four of the serial channels 31 connect to respective drink processors 35A, 35B, 35C and 35D. Each drink processor 35 is coupled to sensing devices and operating devices on a respective one of the levels A-D of the printing unit 10. In addition to receiving a press speed feedback signal through a pair of lines 37 and press monitor and control 38 from a speed sensor 36 mounted on the units 10A, each drink processor 35A–D produces output signals which control the solenoid valves 31 on the spray bars 26 and the page packs 404 for the ink rail 400. The drink processors 35A-D also control color register.

Figure 5:
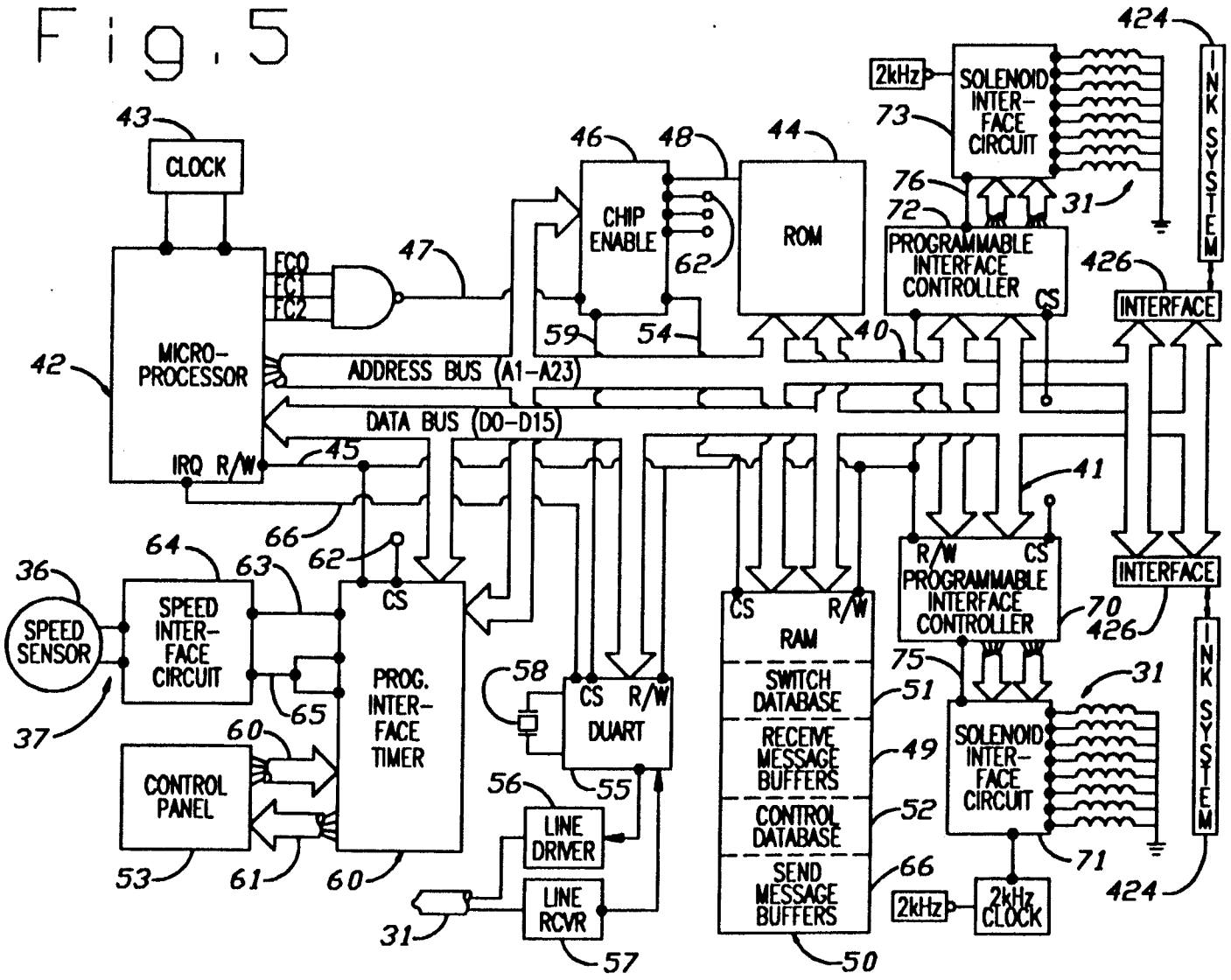
FIG. 5 is an electrical schematic diagram of a dampener, register, ink ("drink") processor which forms part of the unit controller of FIG. 4.

Referring particularly to FIG. 5, each drink processor 35 is structured about a 23-bit address bus 40 and a 16-bit data bus 41 which are controlled by a 16-bit microprocessor 42. The microprocessor 42 is a model 68000 sold commercially by Motorola, Inc. which is operated by a 10 mHz clock 43. In response to program instructions which are stored in a read-only memory (ROM) 44, the microprocessor 42 addresses elements of the drink processor 35 through the address bus 40 and exchanges data with the addressed element through the data bus 41. The state of a read/write (R/W) control line 45 determines if data is read from the addressed element or is written to it. Those skilled in the art will recognize that the addressable elements are integrated circuits which occupy a considerable address space. They are enabled by a chip enable circuit 46 when an address within their range is produced on the address bus 40. The chip enable circuit 46 is comprised of logic gates and three PAL16L8 programmable logic arrays sold commercially by Advanced Micro Devices, Inc. As is well known in the art, the chip enable circuit 46 is responsive to the address on the bus 40 and a control signal on a line 47 from the microprocessor 42 to produce a chip select signal for the addressed element. For example, the ROM 44 is enabled through a line 48 when a read cycle is executed in the address range $F00000 through $F7FFFF. The address space occupied by each of the addressable elements in the drink processor 35 is given in Table A.

TABLE A

| | | |
|---|---|---|
| ROM 44 | $F00000 | to $F7FFFF |
| RAM 50 | $000000 | to $06FFFF |
| Programmable Interface | | |
| Timer 60 | $300340 | to $30037F |
| Timer 100 | $300360 | |
| PC0 | $300358 | |
| PC1 | $300358 | |
| Programmable Interface | | |
| Controller 70 | $300380 | to $3003BF |
| Timer 85 | S3003A0 | |
| Port PA | $300390 | |
| Port PB | $300392 | |
| PC3 | $300398 | |
| Programmable Interface | | |
| Controller 72 | $3003C0 | to $3003FF |
| DUART 55 | $200000 | to $20003F |

Referring still to FIG. 5, whereas the ROM 44 stores the programs or "firmware" which operates the microprocessor 42 to carry out the functions of the drink processor 35, a read/write random access memory (RAM) 50 stores the data structures which are employed to carry out these functions. As will be described in more detail below, these data structures include elements which are collectively referred to herein as a switch database 51, a control database 52, receive message buffers 49, and send message buffers 66. For example, the switch database 51 indicates the status of various switches on the local control panels 53, whereas the control database 52 stores data indicative of press speed, nozzle pulse rate, and nozzle pulse width and parameters for the ink injector system. The RAM 50 is enabled for a read or write cycle with the microprocessor 42 through a control line 54.

The drink processor 35 is coupled to one of the serial channels 31 of the communications processor 30 by a dual universal asynchronous receiver/transmitter (DUART) 55. The DUART 55 is commercially available as an integrated circuit model 68681 from Motorola, Inc. It operates to convert message data written to the DUART 55 by the microprocessor 42 into a serial bit stream which is applied to the serial channel 31 by a line drive circuit 56 that is compatible with the RS 422 standard. Similarly, the DUART 55 will receive a serial bit stream through a line receiver 57 and convert it to a message that may be read by the microprocessor 42. The DUART 55 is driven by a 3.6864 mHz clock produced by a crystal 58 and is enabled for either a read or write cycle through control line 59.

The press speed feedback signal as well as signals from the local control panel 53 are input to the drink processor 35 through a programmable interface timer (PIT) 60. The PIT 60 is commercially available in integrated circuit form as the model 68230 from Motorola, Inc. It provides two 8-bit parallel ports which can be configured as either inputs or outputs and a number of separate input and output points. In the preferred embodiment, one of the ports is used to input switch signals from the control panel 53 through lines 60, and the second port is used to output indicator light signals to the control panel 53 through lines 61. The PIT 60 is enabled through control line 62 and its internal registers are selected by leads A0–A4 in the address bus 40.

In addition to the parallel I/O ports, the PIT 60 includes a programmable timer/counter. This timer may be started and stopped when written to by the microprocessor 42 and it is incremented at a rate of 312.5 kHz by an internal clock driven by the 10 mHz clock 43. When the timer is started, a logic high pulse is also produced at an output 63 to a speed interface circuit 64. When the interface circuit 64 subsequently produces a pulse on input line 65, as will be described in detail below, the timer stops incrementing and a flag bit is set in the PIT 60 which indicates the timer has stopped. This flag bit is periodically read and checked by the microprocessor 42, and when set, the microprocessor 42 reads the timer value from the PIT 60 and uses it to calculate current press speed.

Referring still to FIG. 5, the solenoid valves 31 on each spray bar assembly 26 are operated through a programmable interface controller (PIC) 70 or 72 and an associated solenoid interface circuit 71 or 73. The PICs 70 and 72 are commercially available integrated circuits sold by Motorola, Inc. as the model 68230. Each includes a pair of 8-bit output registers as well as a single bit output indicated at 75 and 76. Each output register can be separately addressed and an 8-bit byte of data can be written thereto by the microprocessor 42. The two 8-bit bytes of output data are applied to the respective solenoid interface circuits 71 and 73. As will be explained in more detail below, the solenoid valves 31 are turned on for a short time period each time a pulse is produced at the single bit output of the PICs 70 and 72. This output pulse is produced each time an internal timer expires, and the rate at which the timer expires can be set to a range of values by the microprocessor 42. The time period which each solenoid valve 31 remains energized is determined by the operation of the solenoid interface circuits 71 and 73, which in turn can be separately configured by writing values to the registers in the PICs 70 and 72. As a result, the rate at which the spray bars 26 are pulsed on is under control of the programs executed by the microprocessor 42, and the duration of the spray pulses from each nozzle 30 of the spray bars 26 can be separately controlled. Similarly, the ink injector system 424 having the page packs 404, the ink adjustment modules 410 and the ink rail 400 is connected via interface 426 to the address bus 40 and the data bus 41. Operation is substantially equivalent to operation of the spray bars 26.

Figure 6:
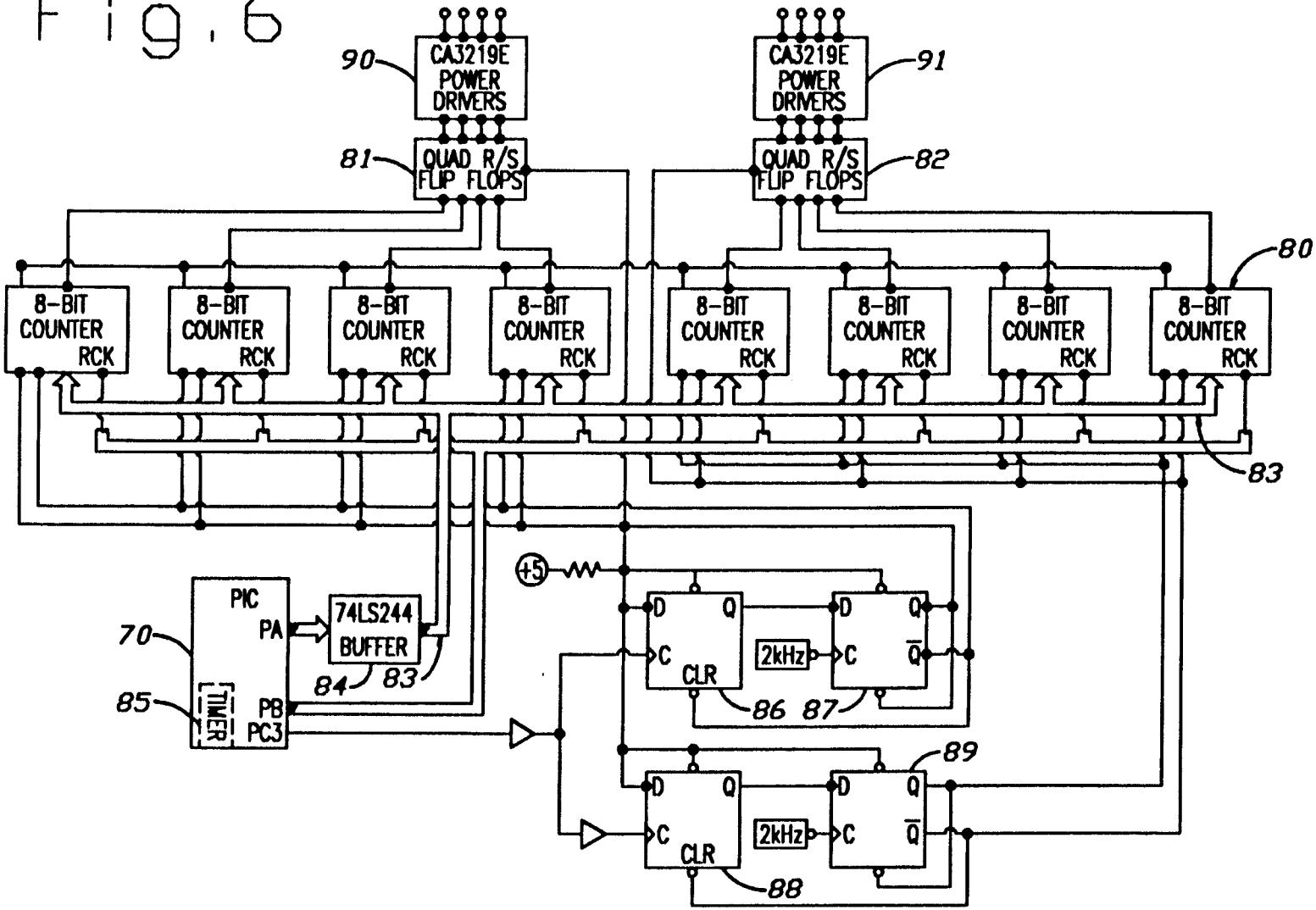
FIG. 6 is an electrical schematic diagram of a solenoid interface circuit which forms part of the drink processor of FIG. 5.

The solenoid interface circuits 71 and 73 are shown in FIG. 6 and it should be understood that the interface circuits 71, 73 and 426 are virtually identical. Each includes a set of eight 8-bit binary counters 80 and a set of eight R/S flip-flops 81 and 82. The counters 80 are available in integrated circuit form as the 74LS592 from Texas Instruments, Inc. and they each include an internal 8-bit input register. This input register is loaded with an 8-bit binary number on output bus 83 when a pulse is applied to an RCK input of the counter 80. The RCK inputs of the eight counters 80 are connected to respective ones of the output terminals PB0–PB7 of the PIC 70, and the eight leads in the output bus 83 are driven by the output terminals PA0–PA7 of the PIC 70 through a buffer 84. Thus, any or all of the registers in the counters 80 can be loaded with a binary number on the PA output port of the PIC 70 by enabling the counter's RCK input with a "1" on the corresponding lead of the PB output port. As will be described in more detail below, this circuitry is used to separately preset each 8-bit counter 80 so that the time interval which each of the solenoid valves 30 remains on can be separately controlled.

Referring still to FIG. 6, an output pulse is produced at the PC3 output pin of the PIC 70 each time an internal timer 85 expires. The timer 85 is preset with a calculated current pulse rate value by the microprocessor 42. Each time the timer 85 expires, two phase displaced pulses are produced by a set of four D-type flip-flops 86–89. The Q output of flip-flop 87 sets the RS flip-flops 81 on the leading edge of one pulse and it presets four of the counters 80 with the values stored in their respective input registers. On the trailing edge of this first pulse, the $\overline{Q}$ output of the flip-flop 87 returns to a logic low which enables the same four counters to begin counting. The remaining four counters 80 and the R/S flip-flops 82 are operated in the same manner by the Q and $\overline{Q}$ outputs of the flip-flop 89. The only difference is that the operation of the flip-flop 89 is delayed one-half the time period between successive pulses from the flip-flop 87.

The eight counters 80 are incremented by 2 kHz clock pulses until they reach the all ones condition. At this point the output of the counter 80 goes to a logic low voltage and it resets the R/S flip-flop 81 or 82 to which it connects. The output of each R/S flip-flop 81 or 82 controls the operation of one of the solenoid valves 31 through power drivers 90 and 91 and, thus, each valve 31 is turned on when the flip-flops 81 and 82 are set, and they are each turned off as their associated counter 80 overflows and resets its R/S flip-flop. The outputs of the drivers 90 are connected to the first, third, fifth and seventh nozzle solenoids and the outputs of the drivers 91 are connected to the second, fourth, sixth and eighth nozzle solenoids. As a result, nozzles 1, 3, 5 and 7 are turned on each time a pulse is produced at PIC output terminal PC3 and nozzles 2, 4, 6 and 8 are turned on a short time interval later (i.e. greater than 5 milliseconds later). Each nozzle 30 is then turned off separately as their corresponding counters 80 overflow. It should be apparent, therefore, that the spray bar solenoids are pulsed on at the same rate, but the duration of each is left on, and hence the amount of dampening water delivered to the fountain roller 25, is separately controllable by the value of the 8-bit binary numbers loaded into the respective counter input registers.

Figure 7:
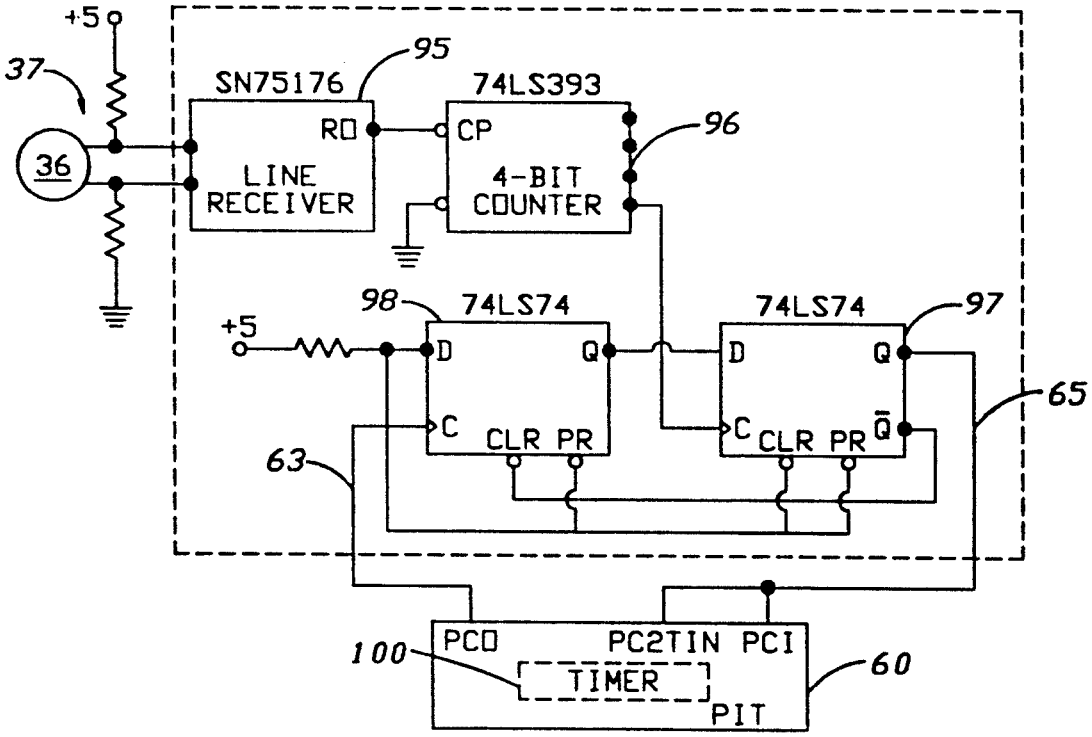
FIG. 7 is an electrical schematic diagram of a speed interface circuit which forms part of the drink processor of FIG. 5.

Referring particularly to FIGS. 5 and 7, the speed interface circuit 64 couples the digital incremented speed feedback signal received from the speed sensor 36 to the PIT 60. The speed sensor 36 produces a logic high voltage pulse for each incremental movement of the web through the printing unit. In the preferred embodiment, a magnetic sensor model 1-0001 available from Airpax Corporation is employed for this purpose, although any number of position feedback devices will suffice. The speed sensor's signal is applied to a line receiver 95 which produces a clean logic level signal that is applied to the input of a 4-bit binary counter 96. The counter 96 produces an output pulse each time sixteen feedback pulses are produced by the speed sensor 36. This overflow is applied to the clock terminal of a D-type flip-flop 97 which switches to a logic state determined by the logic state applied to its D input. The D input is in turn driven by a second flip-flop 98 which is controlled by the PCO output of the PIT 60 and the $\overline{Q}$ output of flip-flop 97.

When the press speed is to be sampled, a "1" is written to the PCO output of the PIT 60. This transition clocks the flip-flop 98 to set its Q output high and to thereby "arm" the circuit. As a result, when the next overflow of the 4-bit counter 96 occurs, the flip-flop 97 is set and a logic high voltage is applied to the PC2TIN and PC1 inputs of the PIT 60. The $\overline{Q}$ output of flip-flop 97 also goes low to reset flip-flop 98 and to thereby disarm the circuit. As long as input PC2TIN is high, an internal timer 100 in the PIT 60 is operable to measure the time interval. The input PC1 may be read by the microprocessor 42 to determine when a complete sample has been acquired. After sixteen feedback pulses have been received, the counter 96 again overflows to reset the flip-flop 97 and to thereby stop the timer 100 in the PIT 60. Input PC1 also goes low, and when read next by the microprocessor 42, it signals that a complete sample has been acquired and can be read from the PIT 60. The entire cycle may then be repeated by again writing a "1" to the PCO output of the PIT 60.

While many means are available for inputting an indication of press speed, the speed feedback circuit of the present invention offers a number of advantages. First, the effects of electronic noise on the measured speed are reduced by the use of the counter 96. The error caused by a noise voltage spike on the input lines is effectively reduced to about one sixteenth the error that would result if speed were measured by sensing the feedback pulse rate directly. In addition, by using the timer in the PIT 60 to record the time interval and save the result, the microprocessor 42 is not burdened with a continuous monitoring of the speed feedback signal. Instead, when the system requires an updated sample of press speed, the microprocessor checks the PIT 60 and reads the latest value stored therein. It then initiates the taking of another sample and continues on with its many other tasks.

Figure 8:
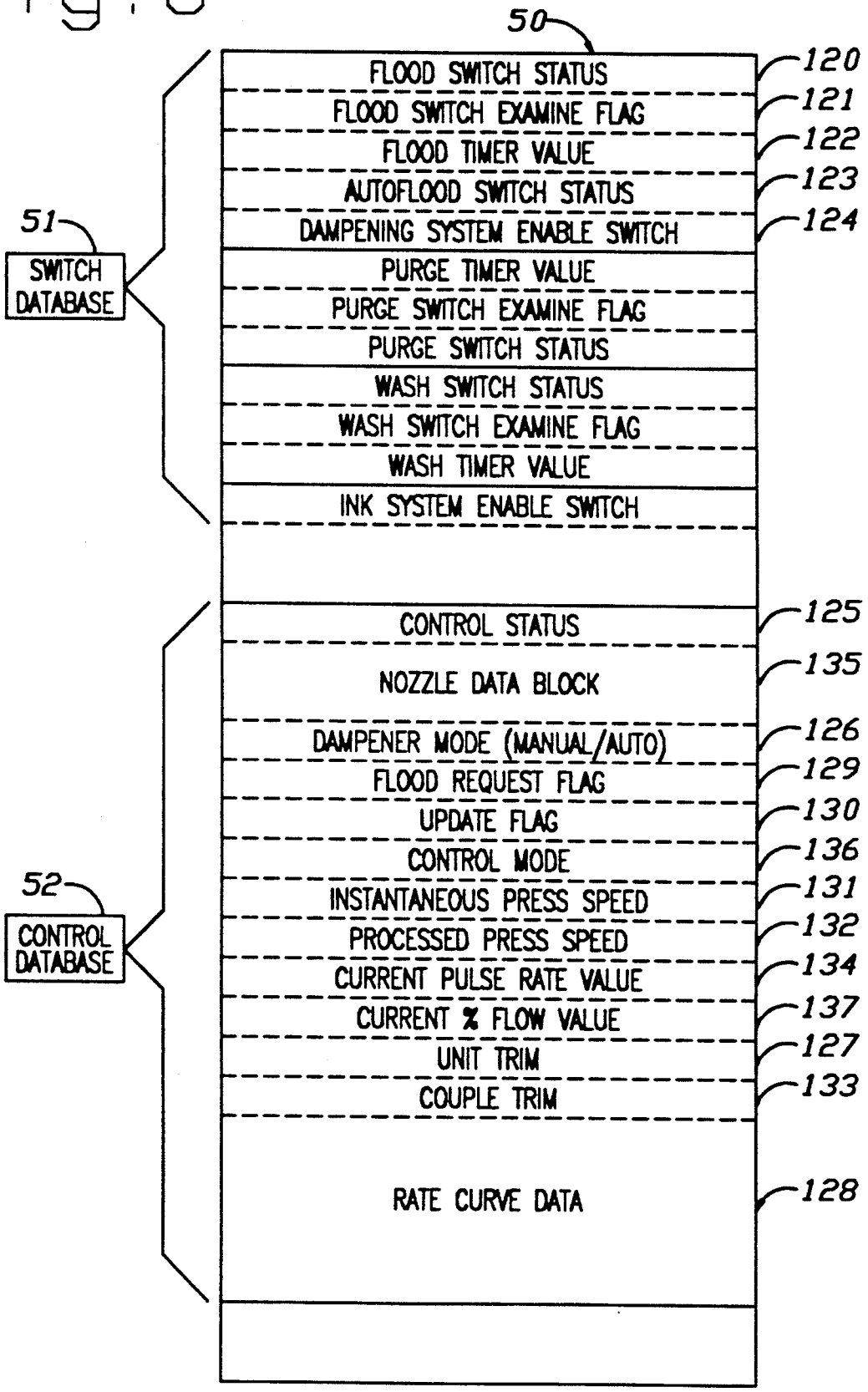
FIG. 8 is a schematic representation of important data structures which are stored in the RAM of FIG. 5.

Referring to FIG. 8, the data structures which are employed by the preferred embodiment of the present invention to control the spray bars 26 are stored in the RAM 50. An equivalent data structure is provided for the ink injector system and only the data structure for the spray bars will be described in detail. As indicated above, these data structures are collectively referred to as the switch database 51 and the control database 52. The structure of these two databases 51 and 52 are illustrated in FIG. 8 for one printing couple. Similar data is stored in the databases 51 and 52 for the other printing couple in the unit 10.

The switch database 51 includes an image of the switch states on the local control panel 53 (FIG. 5). The operator depresses a "FLOOD" switch when extra dampening water is to be applied during startup. As will be described below, when this occurs, the dampening water flow rate is increased 25% for a preset time interval. To support these functions, a flood switch status word 120, a flood switch examine flag 121 and a flood timer value 122 are stored in the RAM 50. Flood switch status 120 is updated every 100 milliseconds as will be described below to reflect the current state of the control panel switch. The other two data structures are employed to recognize the flood request and implement the request for a preset time interval.

When an autoflood signal is received from the press monitor and control 38 during automatic sequencing at the beginning of a press run, dampening water is also increased. The status of this signal is stored at an autoflood switch status word 123, and as long as it is present, increased dampening water will be produced. And finally, the dampening system can be disabled by the operator and this event is stored at 124.

A number of other data structures are contained in the switch database 51 at least one of which pertains to the inkrate control system for the printing unit 10.

The data structures in the control database 52 which are required by the dampening system are illustrated in FIG. 8. These include a control status 125 which indicates if the control is in the process of making a requested change ("change in progress") or if no changes have been requested ("idle"). Control status 125 also includes a "changes not complete counter" which indicates at any time the number of controllable nozzles which are undergoing changes. A dampener mode word 126 indicates if the dampening system is in either manual or automatic mode. In the manual mode the dampening flow rate is set to a value indicated as unit trim 127, which can be manually altered from the master work station 11 or a local panel 53 (FIG. 1). In the automatic mode, the dampening water flow rate is calculated as a function of press speed in accordance with stored rate curve data 128 as will be described in more detail below.

A flood request flag 129 is set when the flood function is being performed and an update flag 130 is set when a significant change in press speed has occurred or new rate curve data 128 has been down loaded from the master work station 11. As will be explained in detail below, the press speed is measured every 100 milliseconds and stored as the instantaneous press speed 131. If the instantaneous press speed 131 differs by more than ±5% from a processed press speed stored at 132, then the processed press speed 132 is updated with the newly measured value and the update flag 130 is set. The processed press speed 132 is used in combination with the rate curve data 128 to calculate a new dampening water flow rate when the dampening system is in the "AUTO" mode. This is converted to a pulse rate and is modified by a stored couple trim value 133 and increased further if the flood request flag 130 is set. The resulting current pulse rate value is stored at 134 and is output to the timer 85 in the PIC 70 (FIG. 6). The couple trim value 133 may be changed from the local control panel 53 to provide a means for manually adjusting the dampening water flow rate while in the AUTO mode. A current % flow value stored at 137 is a number which may be read out and displayed. It expresses the current pulse rate value 134 as a percentage of the maximum pulse rate value and, hence, it indicates the percentage of maximum dampening water flow rate which is currently being applied.

Not only is the pulse rate applied to the spray bar nozzles 30 controlled, but also, the width of each pulse is separately controlled. This function is supported by a nozzle data block 135. The data block 135 stores information on each of the eight controllable nozzles 30 which will be described in more detail below with respect to FIG. 9C.

Figure 9A:
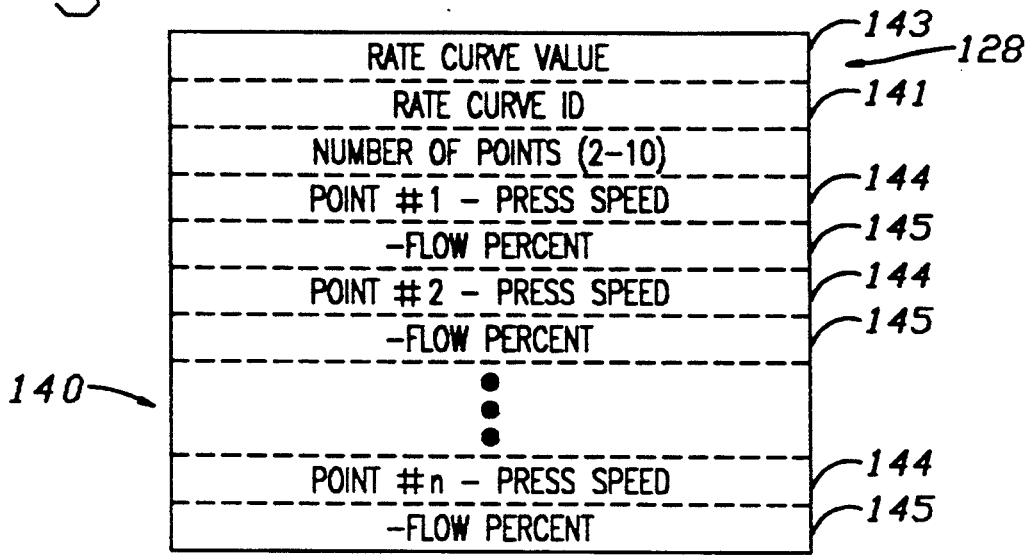
FIGS. 9A-9C are schematic representations of specific data structures which are shown as blocks in FIG. 8.
Figure 9B:
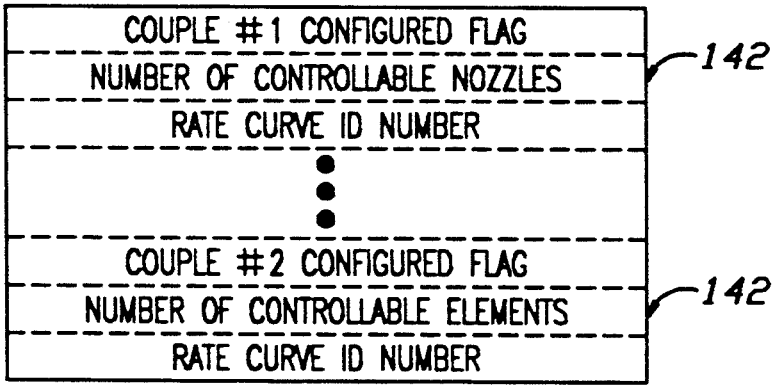

The rate curve data 128 is illustrated in detail in FIG. 9A. It may include one or more rate curve data blocks 140 that may be used with one or both printing couples. Each data block 140 includes a rate curve ID 141 which uniquely identifies it. Each printing couple is associated with a particular rate curve data block by this rate curve ID number. As illustrated in FIG. 9B, a configuration database stored in the RAM 50 includes configuration records 142 for each printing couple. These configuration records 142 include a rate curve ID number which link each printing couple to one of the stored rate curve data blocks 140. These configuration records 142 can be altered by messages from the master work station 11 and, hence, the rate curve data block 140 associated with a particular printing couple can be altered at any time.

Figure 12:
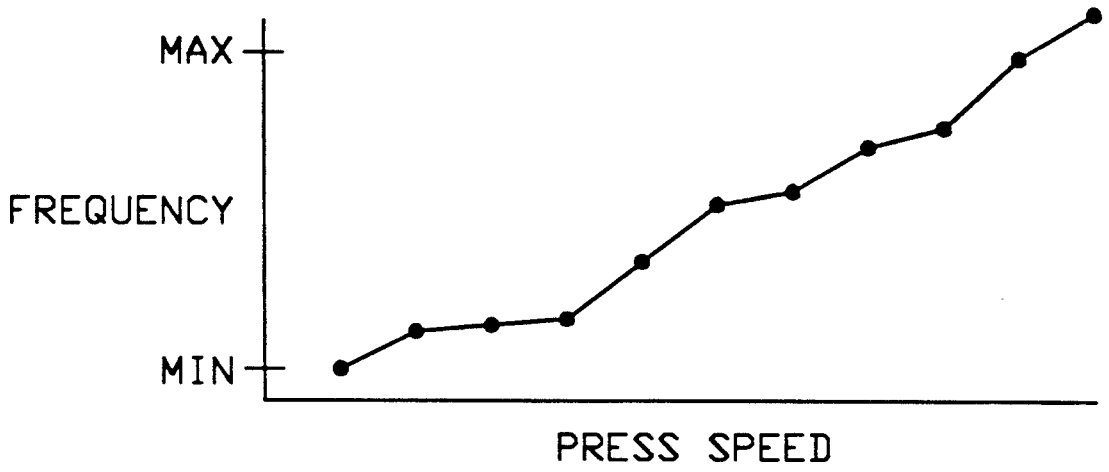
FIG. 12 is a graphic representation of a damp rate curve defined by damp rate curve data stored in the drink processor of FIG. 5.
Figure 13:
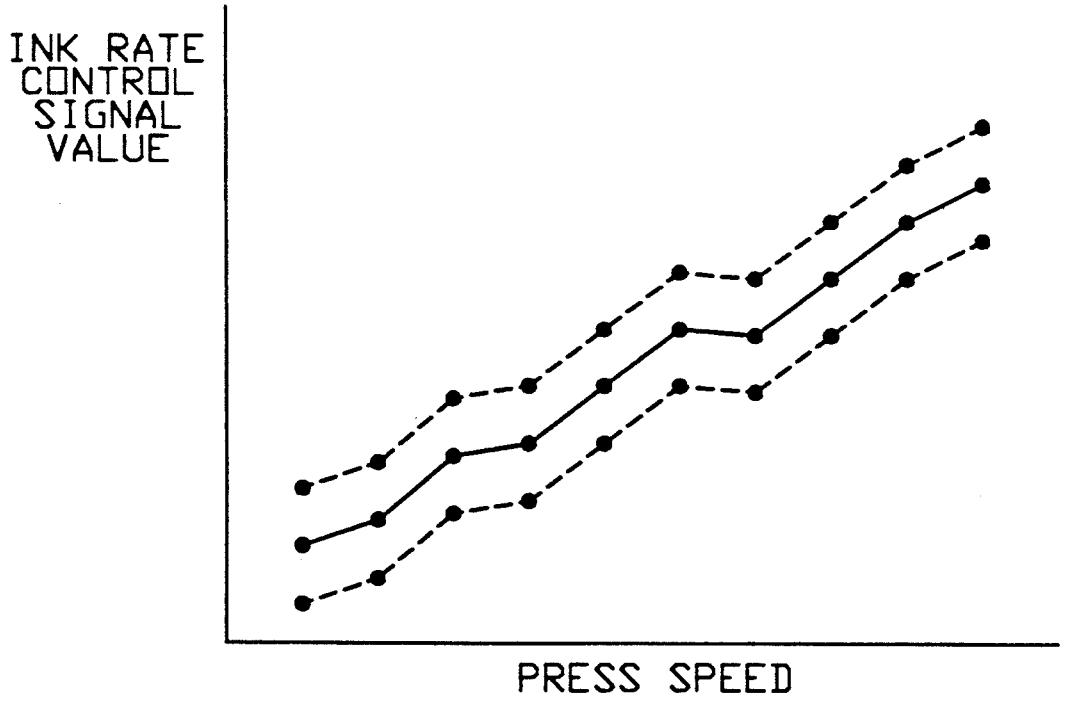
FIG. 13 is a graphic representation of an ink rate curve defined by ink rate curve data stored in the drink processor of FIG. 5.

Each rate curve data block 140 also stores a rate curve value 143 which indicates the current dampening water flow rate as calculated from the data in this rate curve data block 140 and the processed press speed 132. A third entry in the block 140 is the number of rate curve points which are stored in this data block 140 and the remainder of the data block 140 is comprised of the data which defines each of these points. Each point is defined by a press speed number 144 and a flow percent number 145. Anywhere from two to ten points may be stored which indicate the desired dampening water flow rates across a range of press speeds. As will be described in more detail below, the rate curve value 143 is calculated by linearly interpolating between the flow percent numbers 145 for the points which have press speed numbers 144 to each side of the processed press speed 131. An example of the curves for the control of the spray bars 26 is depicted in FIG. 12 and the curves for the control of the ink injector system is depicted in FIG. 13.

Figure 9C:
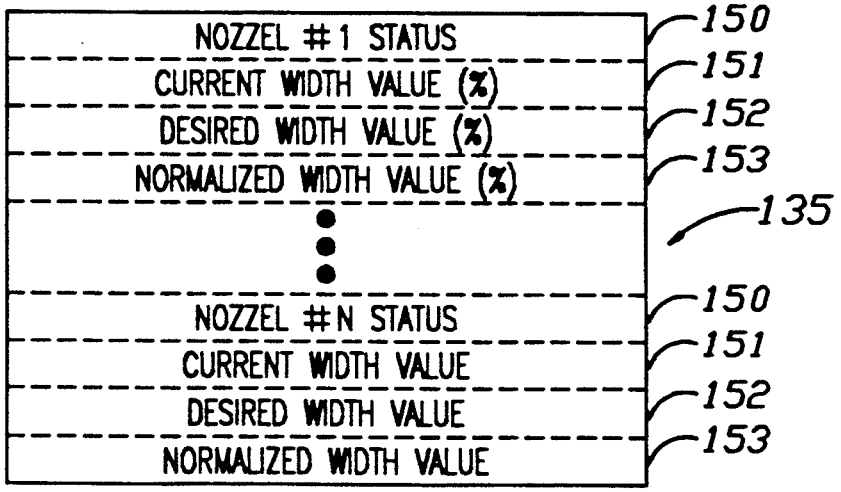

Referring particularly to FIGS. 9B and 9C, each printing couple may have up to eight separately controllable nozzles 30 on its spray bar 26. The number is indicated in the configuration record 142 for each couple. The nozzle data block 135 in the control database 52 stores data on each controllable nozzle 30. More specifically, the status 150 of each nozzle is stored (idle/change requested/change in process). Also, stored in this block 135 is the current pulse width value 151 which indicates the value actually being output to the PIC 70 or 72 (FIG. 5), the desired pulse width value 152 which indicates the pulse width which has been commanded, and the normalized pulse width value 153 which indicates the current value unmodified by any flood request or the like. The nozzle data block 135 is employed to control each nozzle 30 and to implement a change in the pulse width produced by each nozzle 30 in response to messages received over the serial link 31 from the communications processor 30 (FIG. 4).

The programs which direct the operation of the microprocessor 42 and, hence, control the operation of the drink processor 35 are stored in the ROM 44. These programs include a set of programs which carry out specific tasks or processes as well as a real time clock interrupt service routine and an operating system program.

The development of software for the microprocessor 42 can be performed in numerous different ways by one skilled in the art. One software embodiment for controlling the spray bar assembly 26 is disclosed in U.S. Pat. No. 4,899,653. The control of inking can be accomplished with a similar software program.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A method of providing a desired printing quality state for a printing press, the method comprising the steps of: providing an ink rail in a printing press, providing a plurality of ink adjusting modules in at least one page pack of a printing couple in the printing press, each of the ink adjusting modules being provided for adjusting an associated plunger assembly for dispensing ink to the ink rail in the printing press, providing for each ink adjusting module an ink control lever which contacts the plunger assembly to change the ink volume being pumped by the associated plunger assembly to the ink rail, and providing a mechanical stop for the ink control lever and an adjustable ink control rod that contacts the ink control lever;

placing the printing couple in a zero mode;

positioning the ink control lever at the associated mechanical stop;

operating a bidirectional motor in each ink adjusting module to move the ink control lever to a position corresponding to a desired printing quality via the ink module control rod which is connected to the motor and which contacts the control lever; and for each ink adjusting module, measuring the position of the motor with a potentiometer;

storing the measured position of each motor as position values in a memory, the position values corresponding to the desired printing quality for each of the ink adjusting modules.

2. The method according to claim 1, wherein the method further comprises the steps of: providing at least one type of ink for use in the printing press, forming a set of the position values corresponding to the at least one type of ink used in the printing press.

3. The method according to claim 2, wherein the method further comprises the step of storing a plurality of sets of position values corresponding to a plurality of different types of inks for use in the printing press.

4. The method according to claim 1, wherein said method further comprises the steps of:

retrieving the position values from the memory; and positioning each of the motors according to their respective position value before operating the printing press.

5. The method according to claim 3, wherein when the type of ink is changed in the printing press, the method further comprises the step of providing the printing press with a set of position values from the plurality of stored sets of position values which correspond to the new ink type.

6. A method of providing a desired printing quality state for a printing press, the method comprising the steps of: providing an ink rail in the printing press, providing a plurality of ink adjusting modules in the printing press, each of the ink adjusting modules being provided for adjusting an associated plunger assembly for dispensing ink to the ink rail in the printing press, providing for each ink adjusting module an ink control lever which contacts the plunger assembly to change the ink volume being pumped by the associated plunger assembly to the ink rail, and providing a mechanical stop for the ink control lever and an adjustable ink control rod contacting the ink control lever;

positioning the ink control lever of each ink adjusting module at the associated mechanical stop;

operating a bidirectional motor in each ink adjusting module to move the ink control lever to a position corresponding to a desired printing quality via the ink module control rod which is connected to the motor and which contacts the control lever;

for each ink adjusting module, measuring the position of the motor with a potentiometer;

storing the measured position of each motor as position values in a memory, the desired printing quality being related to paper type, ink type and dampening solution used in the printing press, and storing a plurality of sets of position values for different paper types, ink types and dampening solutions;

for operating the printing press with a selected paper type, ink type and dampening solution, retrieving the position values corresponding to the selected paper type, ink type and dampening solution; and positioning each of the motors according to their respective retrieved position values before operating the printing press.

* * * * *